United States Patent [19]

Edsö

[11] 4,429,627

[45] Feb. 7, 1984

[54] METHOD AND APPARATUS FOR MONITORING A PRESS

[76] Inventor: Lennart Edsö, Remmaregränd 3, S-222 51 Lund, Sweden

[21] Appl. No.: 459,571

[22] PCT Filed: May 17, 1982

[86] PCT No.: PCT/SE82/00175

§ 371 Date: Jan. 12, 1983

§ 102(e) Date: Jan. 12, 1983

[87] PCT Pub. No.: WO82/04010

PCT Pub. Date: Nov. 25, 1982

[30] Foreign Application Priority Data

May 19, 1981 [SE] Sweden ..... 8103121

[51] Int. Cl.[3] ..... B30B 15/28

[52] U.S. Cl. ..... 100/35; 100/43; 100/53; 192/129 R

[58] Field of Search ..... 100/35, 53, 46, 48, 100/43; 72/8, 19, 20, 21, 26; 192/129 R, 129 A, 129 B

[56] References Cited

FOREIGN PATENT DOCUMENTS

| | | | |
|---|---|---|---|
| 2001494 | 7/1971 | Fed. Rep. of Germany | 100/53 |
| 2645849 | 4/1978 | Fed. Rep. of Germany | 100/53 |
| 2840683 | 6/1979 | Fed. Rep. of Germany | 100/53 |
| 52-71772 | 6/1977 | Japan | 100/53 |
| 55-144397 | 11/1980 | Japan | 100/53 |
| 682391 | 8/1979 | U.S.S.R. | 100/43 |

OTHER PUBLICATIONS

WO81/00824 (Spalthoff), Apr. 2, 1981.

*Primary Examiner*—Billy J. Wilhite
*Attorney, Agent, or Firm*—Cyrus S. Hapgood

[57] ABSTRACT

In a method and an apparatus for safe-guarding a press (1) by monitoring the press motion, use is made of the fact that the force exerted by the press is an almost invariable function of the position of the upper press platen in relation to the lower press platen. The force exerted by the press is continuously sensed during each pressure stroke by means of transducers (6). The instantaneous value of the force is compared in a monitoring unit (10) with a reference force value, calculated during the first pressure stroke, at each one of the subsequent positions of the upper press platen of the press in relation to the lower press platen thereof. This comparison is repeated for each such position during the pressure stroke. The monitoring unit (10) directly interrupts the press motion if, on comparison, the sensed force value in any position deviates from the reference force value by more than a predetermined amount. As a criterion for directly interrupting the press motion, also the off-line position of the upper press platen may be utilized.

5 Claims, 5 Drawing Figures

METHOD AND APPARATUS FOR MONITORING A PRESS

Figure 1:
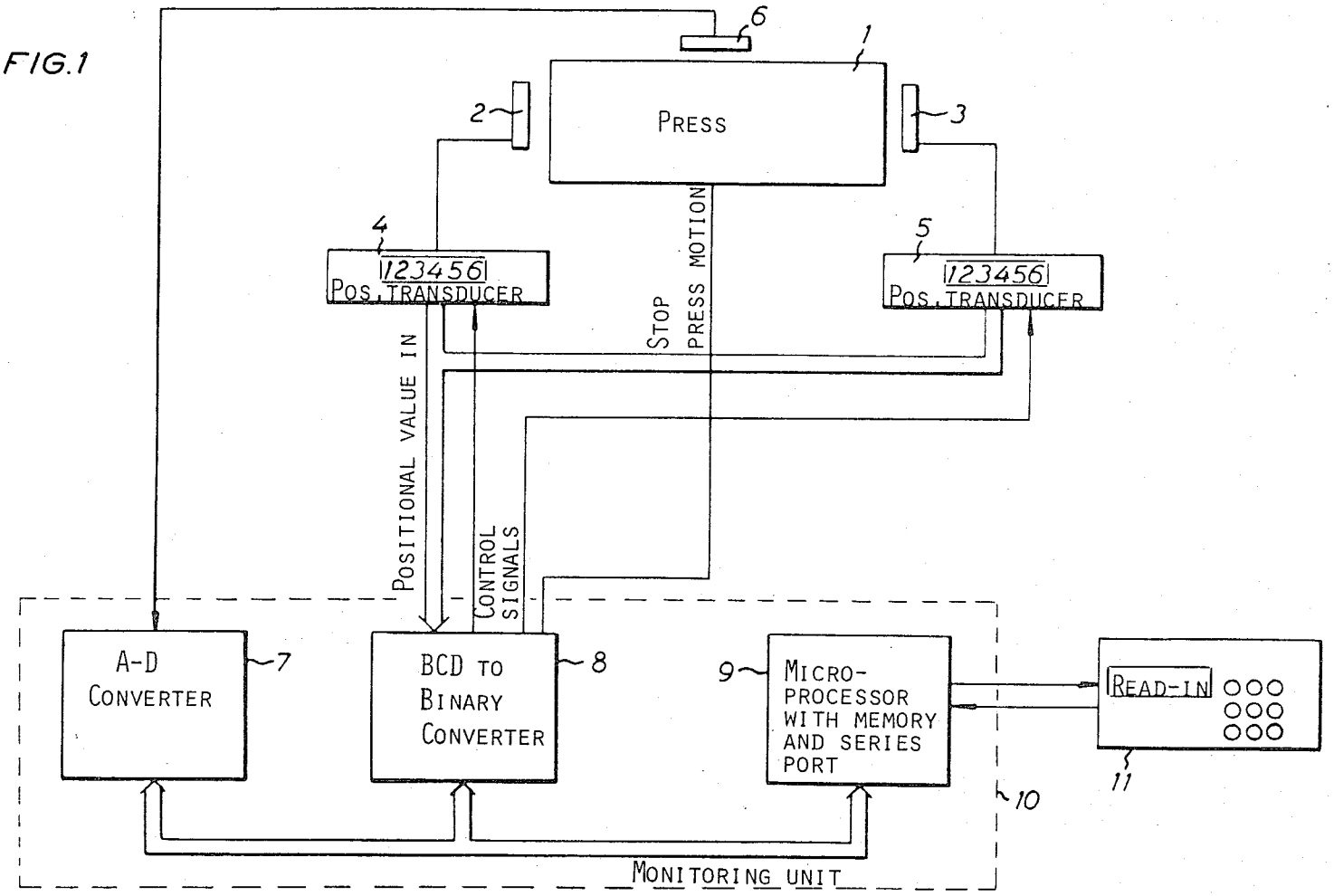

The present invention relates in general to presses, and, in particular, to a tool guard for presses. More precisely, the present invention relates to a method and an apparatus for monitoring the pressure stroke in a press with the intention of preventing damage to the press, the press tool or the workpiece.

Presses which operate with high or extremely high forces are sensitive in so far as relatively simple operating errors may result in destruction of the press tool, and, in certain cases, of the press itself. In view of the fact that capital costs for a single tool for such presses may amount to tens of thousands of dollars, it is, naturally, desirable that such operating errors be prevented or at least that the press be stopped before such an error has caused any damage to the tool, the press and/or the workpiece.

Thus, there is a clearly documented need of a protective device for such presses, a need which has persisted for a considerable time. Nevertheless, no satisfactory solution to this problem has been put forward in the art.

Granted, it is previously known in the art to sense the force exerted by a press during its stroke and to compare this force with a maximum permitted force in the press for the purposes of arresting the pressure stroke as soon as the sensed force exceeds that permitted. Unfortunately, this technique does not prevent destruction of the press tool, since a considerably weaker force than the maximum permitted may give rise to such undesirable damage during a considerable part of the pressure stroke. This prior art technique can possibly provide protection for the press itself but, thus, not for the tool, nor for the workpiece.

The object of the present invention is, therefore, among other things to realize a method and an apparatus of the type disclosed by way of introduction, these making it possible to prevent damage to the tool, press and workpiece.

According to the invention, the press force exercised by the press is continually sensed during each pressure stroke. Moreover, the instantaneous value of the force is compared with a previously produced reference force value at each one of mutually subsequent positions of the one press platen of the press in relation to its other press platen during the entire stroke. Finally, the press motion is directly arrested if, on comparison, the sensed force value in any position deviates from the reference force value of that position by more than a predetermined amount.

The apparatus for reducing this method to practice comprises at least a first measuring transducer which continuously measures the force exerted by the press during the pressure stroke thereof, at least one positional transducer which continuously senses the position of the one press platen of the press in relation to its other press platen, and a monitoring unit containing a memory, said unit being connected to said transducers, being operative, during the press motion, to compare the instantaneous values of the force with a previously produced, memory-stored reference value at each one of mutually subsequent positions of the one press platen of the press in relation to its other press platen during the pressure stroke, and being operative to directly discontinue the press motion if, on such comparison, the sensed force value at any position deviates from the reference value by more than a predetermined amount.

The nature of the present invention and its aspects will be more readily understood from the following description of the accompanying drawings, and discussion relating thereto.

Figure 2A:
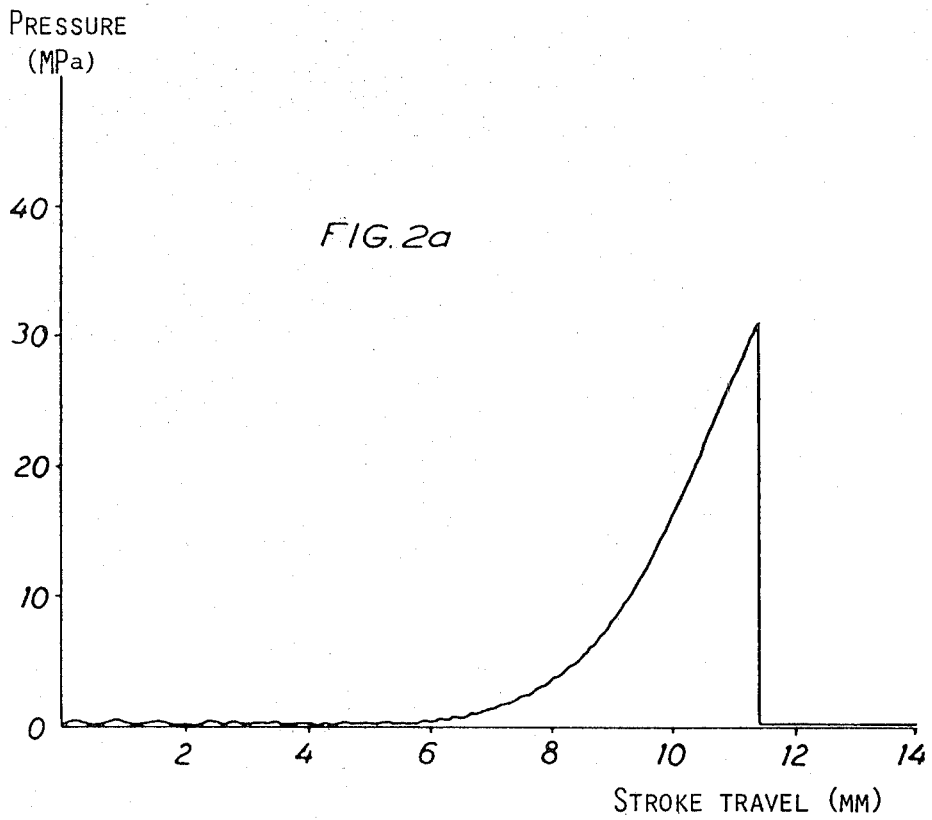
Figure 2B:
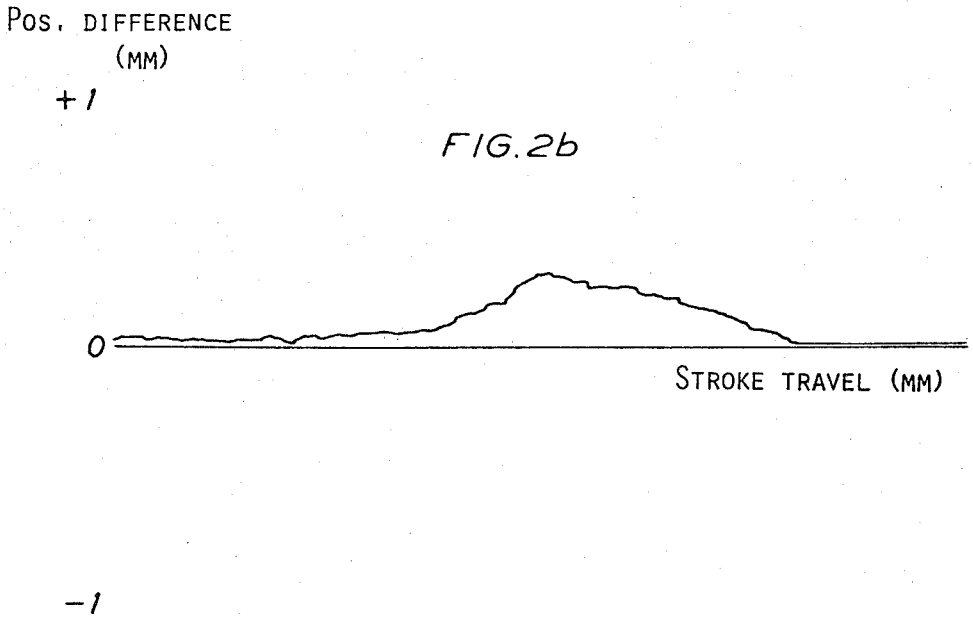
Figure 3A:
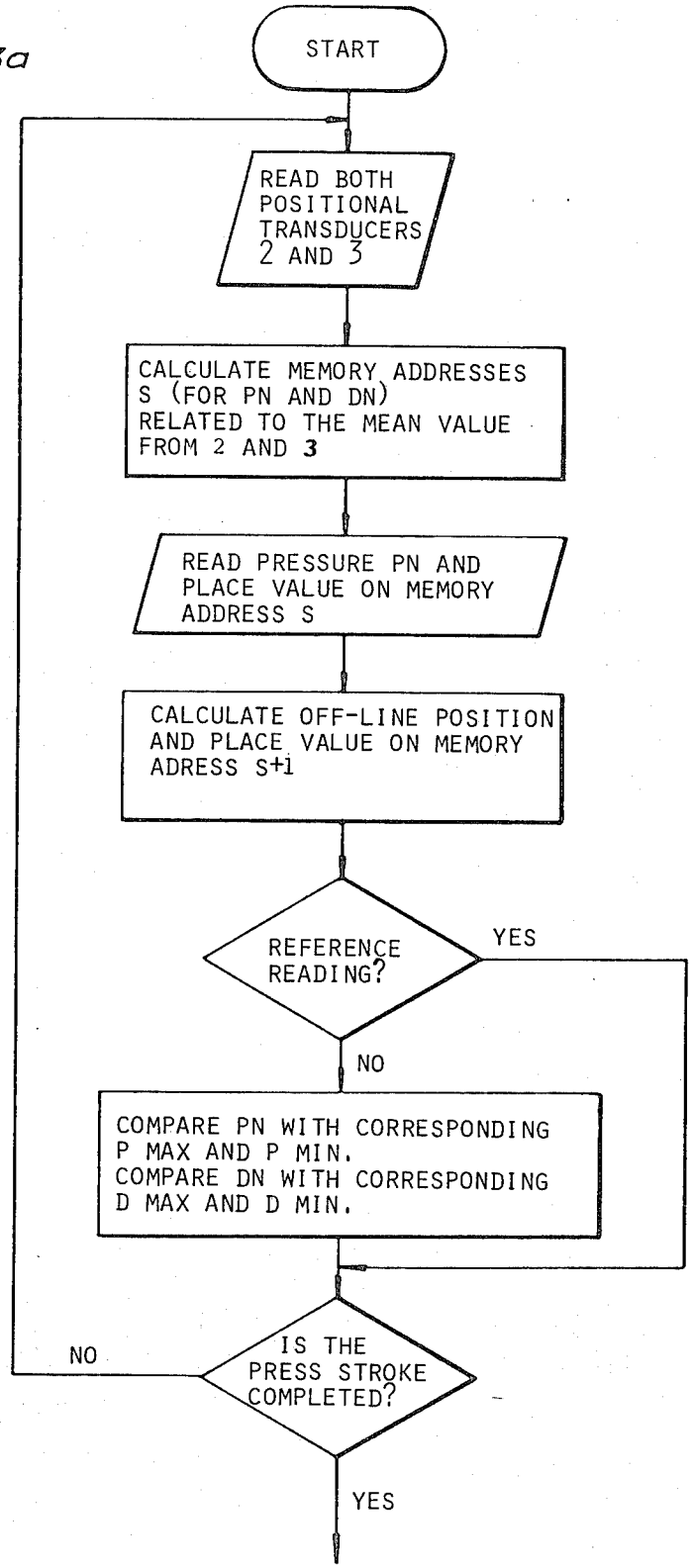
Figure 3B:
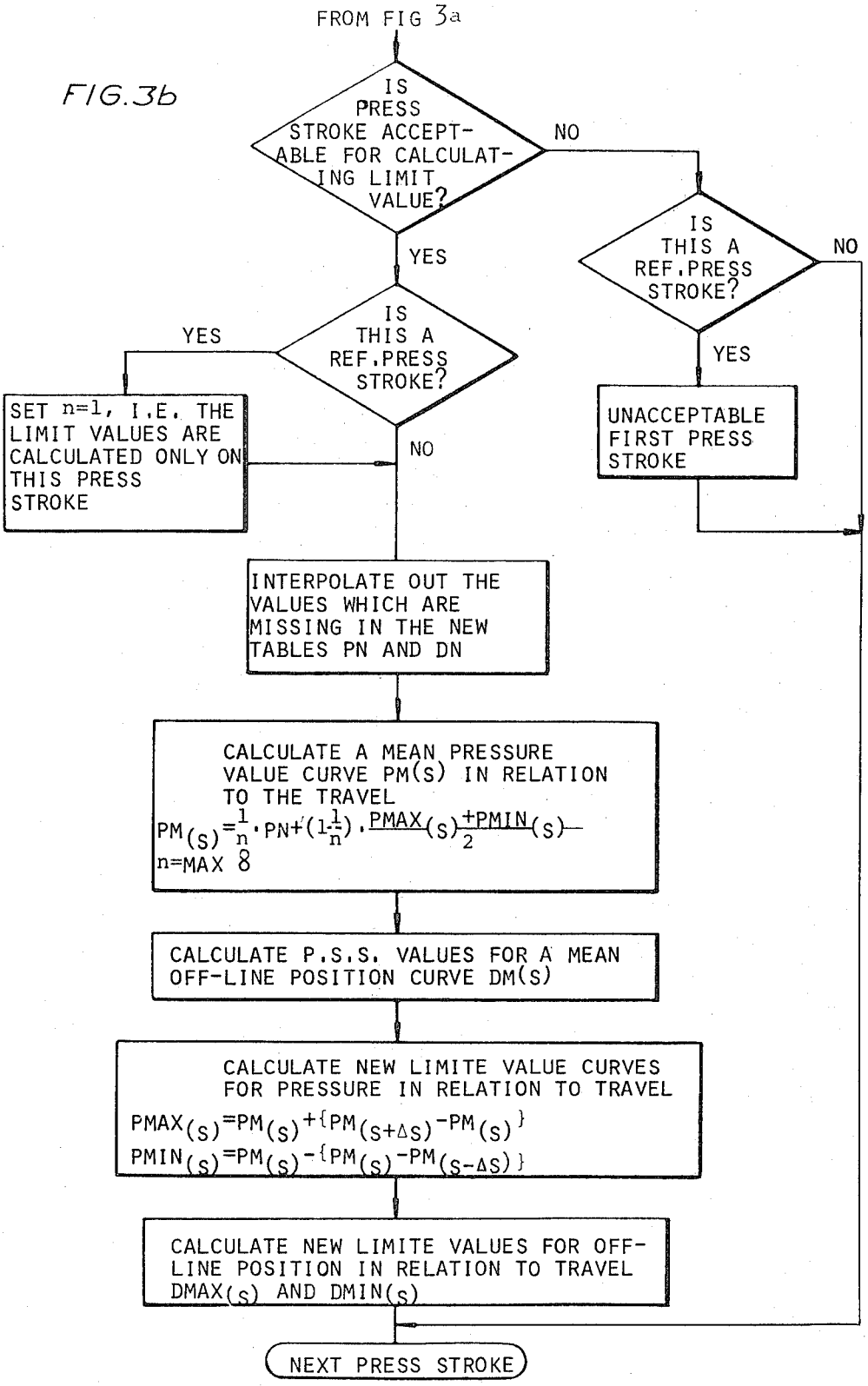

In the accompanying drawings:

FIG. 1 is a block diagram of one embodiment of the apparatus according to the present invention;

FIGS. 2*a* and 2*b* are diagrams showing the pressure increase during a pressure stroke, as well as the motion differences of the upper press platen; and FIG. 3*a* and 3*b* are flow diagrams showing the mode of operation of one embodiment of the apparatus according to the present invention.

The embodiment of the apparatus according to the present invention shown in FIG. 1 and chosen for non-restrictive purposes of exemplification is intended for a drawing press or other press having similar mode of operation. Such a press 1 is illustrated in FIG. 1. Two positional transducers 2 and 3 are mounted on the press 1, these transducers 2 and 3 continuously providing information about the position of the upper press platen or the upper tool half in relation to the lower press platen or the lower tool half, respectively. The two transducers 2 and 3 operate independently of one another and indicate the above-mentioned relative position for two opposing portions of the upper press platen or the upper tool half. The transducers 2 and 3 are of the digital type and are each connected to one positional counter 4, 5 in which the instantaneous values of the signals emitted by the transducers 2 and 3 may be stored at any optional point of time.

Furthermore, a measuring transducer 6 is mounted on the press 1, the transducer 6 being of the analog type and continuously measuring the force exerted by the press in each phase of the pressure stroke. If the press is of the hydraulic type, the measuring transducer 6 may be a pressure transducer disposed in a hydraulic cylinder or in each hydraulic cylinder. The measuring transducer 6 is connected to an analog to digital converter 7 which, thus, receives the analog force or pressure signal of the measuring transducer 6.

Together with a code converter 8 with parallel input-output and a microprocessor 9, the analog to digital converter 7 forms part of a monitoring unit 10. The microprocessor 9 is connected, by the intermediary of an interface, to a control panel 11 which has a keyboard and an indicator for displaying data which may be fed into, or discharged from, the microprocessor 9. The components 7, 8 and 9 are interconnected, and the converter 8 is, moreover, connected to the positional counters 4 and 5 for receiving positional data from these units. Control lines lead from the code converter 8 to buffer stores in the positional counters 4 and 5, from which control lines the points in time for storage of the signals emitted by the positional transducers 2 and 3 may be determined. The converter 8 is further connected to the press 1 by means of a control line through which a stop signal to the press may be transmitted.

Measurements carried out on presses for pressing sheet metal have shown that the force exerted by the press, as a function of the position of the upper press platen in relation to the lower press platen, follows a curve which changes insignificantly from stroke to stroke as long as no operating error is made and on condition that one and the same sheet metal quality and dimension is used. The diagram in FIG. 2*a* shows an example of how the force (pressure) exerted by the press can vary as a function of the relative position of the two halves. FIG. 2*b* shows a curve of the difference between two position indications of positional transducers located in opposition to one another on the upper press platen, as a function of the relative position of the two halves. It has proved that this curve is also repetitive with very slight variations from stroke to stroke as long as the press operating conditions are unchanged.

According to the present invention, the situation accounted for in the preceding paragraph, is utilized in that the two curves are registered at a first stroke of the press, whereafter comparisons are instantaneously made for each subsequent pressure stroke with the previously registered curves, the press being stopped if deviations beyond previously determined values are ascertained.

The mode of operation of the apparatus according to the present invention will be described in greater detail below with reference to FIG. 3*a* and 3*b*. Controlled by the microprocessor 9, the values of the signals emitted by the transducers 2, 3 and 6 are read at such frequency in relation to the velocity of the pressure stroke motion that the force exerted by the press is registered at least for each hundredth of a millimeter of the motion of the upper press platen. As indicated in FIG. 3*a*, a first step comprises, thus, reading of the signal values of the two positional transducers 2 and 3 to the microprocessor 9 by the intermediary of the positional counters 4 and 5 and the code converter 8. In the next step, the mean value of the values issued by the two transducers 2 and 3 is calculated, this mean value being utilized as a basis for providing a memory address S for storage of the values relating, on the one hand, to the force or pressure developed by the press and, on the other hand, the off-line position of the upper press platen, that is to say the difference between the values registered by the positional transducers 2 and 3. Thus, when the pressure value PN read simultaneously with the position is registered at the memory address S, and when the off-line value DN corresponding to the same position has been calculated and registered in the memory address $S+1$, a check is effected to see whether the reading constitutes a reference reading, that is to say the very first reading, or not. If the reading is not a reference reading, the next step consists of a comparison of PN with the upper and lower alarm limit values $P_{max}$ and $P_{min}$ for the pressure (force) calculated in conjunction with a preceding reference reading. In the same manner, the newly-provided off-line value DN is compared with an upper and lower alarm limit $D_{max}$ and $D_{min}$ for the off-line position provided in conjunction with a previous reference reading. If any of the latest-provided values PN and DN lies outside any of the alarm limit values, a stop signal is immediately transmitted to the press.

If the latest-provided values of the pressure and off-line position lie within the alarm limit values, a check is effected to see whether the pressure stroke has been completed. If such is not the case, a return is effected to reading of the positional values of the positional transducers 2 and 3, whereafter the above-described cycle is repeated.

In the case of a reference reading, the above-described comparison step is skipped, since, in this case, no alarm limit values have yet been provided.

When the pressure stroke has been completed, there is effected, as shown in FIG. 3*b*, a check as to whether the pressure stroke is acceptable for calculation of the alarm limit values. If such is not the case, a check is also made as to whether this is a reference pressure stroke. If such is neither the case here, the next pressure stroke is commenced, whereas, if it is a reference pressure stroke, a note is first made to the effect that an unaccepted first pressure stroke has been carried out.

On the other hand, if the pressure stroke is accepted for calculation of the alarm limit values, a check is effected as to whether the pressure stroke is a reference pressure stroke. If such is the case, a factor $n=1$ is included in subsequent calculations. Irrespective of whether it is a reference pressure stroke or not, a check is then carried out as to whether the values of PN and DN have been produced for each hundredth of a millimeter of the press stroke. If a value were lacking for any position, the missing value is provided by interpolation. Thereafter, calculation is effected of the mean pressure curve PM (S) according to the formula disclosed in FIG. 3*b*. Thus, in this calculation, use is made of $n=1$ in the case of a reference pressure stroke, whereas for pressure strokes executed after the reference pressure stroke, n is increased by 1 for each accepted pressure stroke until such time as n attains the value of 8.

Correspondingly, a mean value curve DM(S) is calculated thereafter for the off-line position of the press. Finally, the limit value curves and new limit value curves, respectively, are calculated for pressure and off-line position with respect to the pressure stroke travel.

A complete cycle has thereby been completed, this process being repeated for every new pressure stroke in accordance with that described above.

To sum up, the microprocessor 9 in the monitoring unit 10 registers the signatures of the transducers 2, 3 and 6 and places them in relation to one another, the mean value of the positional transducers being a basic value. For each such value, the associated off-line value and pressure value are registered. The result will, thus, be a number of registered curves in which the position of the upper tool of the press is registered in relation to the position of the lower tool, together with force values and off-line values as a function of the position of the upper tool.

In a first accepted adjustment pressure stroke, all values are registered in the microprocessor 9 and, during subsequent pressure strokes, there is effected instantaneous comparison with the previously registered values. The method indicated in FIG. 3*b* for calculating tolerance limits in relation to a reference curve is, naturally, but a sole example, many other possibilities being obviously available for calculating upper and lower alarm limits. The process according to FIG. 3*b* will realize the advantage that long-term drift in some parameter, for example temperature, cannot trigger an alarm and and stop the press. Such relatively insignificant and slow changes will instead adjust the reference values.

In other words, by means of the apparatus according to the present invention, a check is effected at every position and every point of time of one pressure stroke that this stroke is like previous pressure strokes with respect to occurring forces and off-line as a function of the position of the upper press platen or the upper tool half in relation to the lower press platen and the lower tool half, respectively.

By utilizing the apparatus according to the invention, it will be possible to stop the press before the press proper, the tool or the workpiece is destroyed in the event that no sheet metal has been placed in the press, that two or more sheets have been inserted, that the sheet is incorrectly placed in the tool, that an incorrect sheet metal quality or dimension has been used, or that foreign objects are present in the tool, for example the gripping means of a robot or the like.

The skilled reader of the above description of the apparatus according to the invention will appreciate that the apparatus may be modified without departing from the spirit and the scope of the invention. Thus, more than two positional transducers may be utilized, for example three positional transducers providing sufficient information for a total definition of the plane of the upper press platen.

I claim:

1. A method for safe-guarding a press by monitoring the press motion, wherein the press force exerted by the press is continuously sensed during each pressure stroke; wherein reference force values are produced by registration during a first pressure stroke or calculation as an average for several pressure strokes of the instantaneous values of the sensed press force at each one of mutually subsequent positions of the one press platen of the press in relation to its other press platen; wherein the instantaneous values of the force, for pressure strokes executed after the reference force values have been produced, are compared with the produced reference force values at each one of the mutually subsequent positions of the one press platen in relation to the other press platen during the entire pressure stroke; and wherein the press motion is directly discontinued if, on comparison, the sensed force value in any position deviates from the reference force value of that position by more than a predetermined amount.

2. The method as claimed in claim 1, wherein, apart from the press force, also the off-line position of the said one press platen is sensed during each pressure stroke and is compared with reference values, such that the press motion is also directly discontinued if an unacceptable deviation of the off-line position is detected.

3. The method as claimed in claim 1 or 2, wherein the reference values are adjusted on the basis of values sensed during a plurality of pressure strokes.

4. An apparatus for safe-guarding a press by monitoring the press motion, comprising at least a first measuring transducer (6) which continuously measures the force exerted by the press (1) during one pressure stroke; at least one positional transducer (2, 3) which continuously senses the position of the one press platen of the press in relation to its other press platen; and a monitoring unit (10) containing a memory, said unit being connected to said transducers (2, 3, 6), being operative to produce reference force values by registration during a first pressure stroke or calculation as an average several pressure strokes of the instantaneous values of the sensed press force at each one of mutually subsequent positions of the one press platen of the press in relation to its other press platen; being operative to compare the instantaneous values of the force, for pressure strokes executed after the reference force values have been produced, with the produced reference force values at each one of the mutually subsequent positions of the one press platen in relation to the other press platen during the entire pressure stroke; and being operative directly to discontinue the press motion if, on such comparison, the sensed force value at any position deviates from the reference value by more than a predetermined amount.

5. The apparatus as claimed in claim 4, wherein at least two positional transducers continuously sense the position of said one press platen of the press; and wherein said monitoring unit is operative, on the basis of the output signals of the positional transducers (2, 3), also to determine the off-line position of said one press platen during each pressure stroke, and to compare same with reference values, such that the press motion is also directly discontinued if an unacceptable deviation of the off-line position is detected.

* * * * *